US011969850B2

(12) United States Patent
Valentini

(10) Patent No.: US 11,969,850 B2
(45) Date of Patent: Apr. 30, 2024

(54) HAND-HELD AND HAND-GUIDED RANDOM ORBITAL POLISHING OR SANDING POWER TOOL

(71) Applicant: Guido Valentini, Milan (IT)

(72) Inventor: Guido Valentini, Milan (IT)

( * ) Notice: Subject to any disclaimer, the term of this patent is extended or adjusted under 35 U.S.C. 154(b) by 1060 days.

(21) Appl. No.: 16/783,787

(22) Filed: Feb. 6, 2020

(65) Prior Publication Data

US 2020/0254580 A1 Aug. 13, 2020

(30) Foreign Application Priority Data

Feb. 8, 2019 (EP) ..... 19156102

(51) Int. Cl.

| | |
|---|---|
| ***B24B 23/03*** | (2006.01) |
| ***B24B 41/00*** | (2006.01) |
| ***B24B 41/04*** | (2006.01) |
| ***B24B 47/12*** | (2006.01) |
| ***B24D 7/16*** | (2006.01) |

(52) U.S. Cl.

CPC ..... *B24B 23/03* (2013.01); *B24B 41/007* (2013.01); *B24B 41/04* (2013.01); *B24B 47/12* (2013.01); *B24D 7/16* (2013.01)

(58) Field of Classification Search

CPC ..... B24B 23/02; B24B 23/03; B24B 41/007; B24B 41/04; B24B 47/12; B24D 7/16

See application file for complete search history.

(56) References Cited

U.S. PATENT DOCUMENTS

| | | | |
|---|---|---|---|
| 5,425,666 | A | 6/1995 | Frank et al. |
| 5,458,533 | A | 10/1995 | Barth et al. |
| 5,679,066 | A | 10/1997 | Butz et al. |

(Continued)

FOREIGN PATENT DOCUMENTS

| | | | |
|---|---|---|---|
| CN | 2499636 | Y | 7/2002 |
| CN | 101065217 | A | 10/2007 |

(Continued)

OTHER PUBLICATIONS

JPS63288657A English Translation (Year: 1988).*

(Continued)

*Primary Examiner* — Makena S Markman

(74) *Attorney, Agent, or Firm* — Ware, Fressola, Maguire Barber LLP

(57) ABSTRACT

A hand-held/hand-guided random orbital polishing/sanding power tool has a static body and a motor for driving an eccentric element with a rotational movement about a first rotational axis, and a plate-like backing pad rotatably connected to the eccentric element about a second rotational axis. The first/second axes extend parallel to and spaced apart from one another. Part of an external circumferential surface of the eccentric element has a rotational symmetry re the first axis to form a rotationally symmetric part. The tool has a first bearing between the rotationally symmetric part and the static body so the eccentric element is rotatably guided re the static body about the first axis, and also having a mechanical gear arrangement with two meshing gear wheels arranged between the motor's drive shaft and the eccentric element, and one meshing gear wheel attached to the eccentric element for transmitting torque thereto.

16 Claims, 8 Drawing Sheets

(56) References Cited

U.S. PATENT DOCUMENTS

| | | | | |
|---|---|---|---|---|
| 8,757,285 | B2 * | 6/2014 | Weber | B24B 27/08 173/217 |
| 9,511,472 | B2 * | 12/2016 | Zapp | B24B 41/047 |
| 9,512,908 | B2 * | 12/2016 | Clabunde | B24B 41/007 |
| 10,286,516 | B2 * | 5/2019 | Ishikawa | B24B 23/03 |
| 2011/0036605 | A1 * | 2/2011 | Leong | B25F 5/001 173/47 |

FOREIGN PATENT DOCUMENTS

| | | | | |
|---|---|---|---|---|
| CN | 201012413 | Y | 1/2008 | |
| CN | 202572079 | U | 12/2012 | |
| CN | 204248586 | U | 4/2015 | |
| CN | 108400676 | A | 8/2018 | |
| EP | 0320599 | A1 | 6/1989 | |
| EP | 0591875 | A1 | 4/1994 | |
| EP | 1923173 | A1 | 5/2008 | |
| JP | S63288657 | A | 11/1988 | |
| JP | S63288657 | A * | 11/1988 | B24B 23/03 |
| JP | H10288348 | A | 3/1990 | |
| JP | H06137409 | A | 5/1994 | |
| JP | H107501756 | A | 2/1995 | |
| JP | H07180749 | A | 7/1995 | |
| JP | 6464017 | B2 | 2/2019 | |
| KR | 101593117 | B1 | 2/2016 | |
| WO | 2014023229 | A1 | 2/2014 | |

OTHER PUBLICATIONS

English language Abstract of CN101065217A.
English language Abstract of CN2499636Y.
English language Abstract of CN204248586U.
English language Abstract of CN108400676A.
English language Abstract of CN202572079U.
English language Abstract of CN201012413Y.
English language Abstract of EP0591875.
English language Abstract of EP0320599.
English language Abstract of WO2014023229.
English language Abstract of EP1923173.
English language Abstract of KR101593117.
English language Abstract of JPS63288657A.
English language Abstract of JPH0288348A.
English language Abstract of JP6464017B2.
English language Abstract of JPH07501756A.
English language Abstract of JPH07180749A.
English language Abstract of JPH06137409A.

* cited by examiner

HAND-HELD AND HAND-GUIDED RANDOM ORBITAL POLISHING OR SANDING POWER TOOL

BACKGROUND OF THE INVENTION

1. Field of the Invention

The present invention refers to a hand-held and hand-guided random orbital polishing or sanding power tool. The power tool comprises a static body, a motor, an eccentric element driven by the motor and performing a rotational movement about a first rotational axis, and a plate-like backing pad connected to the eccentric element in a manner freely rotatable about a second rotational axis. The first and second rotational axes extend essentially parallel to one another and are spaced apart from one another.

2. Brief Description of the Related Art

Power tools of the above-identified kind are well-known in the prior art. The static body of the power tool is a fixed part of the power tool which does not move during rotation of the backing pad about the second rotational axis during operation of the power tool. The static body could be fixed to a housing of the power tool or could be the housing itself. The motor for driving the eccentric element may be an electric or a pneumatic motor. In the case of an electric motor, it may be embodied as a brushless motor which is electrically commutated. The electric motor may be of the inrunner type with a static external stator and an internal rotor, or of the outrunner type with a static internal stator and an external rotor. The eccentric element may be driven directly or alternatively indirectly by the motor, for example through a transmission or gear arrangement. The eccentric element is attached to a drive shaft, which may be the motor shaft or an output shaft from a transmission or gear arrangement. A rotational axis of the drive shaft corresponds to a first rotational axis of the eccentric element. The backing pad is connected to the eccentric element in a manner freely rotatable about a second rotational axis. During operation of the power tool the eccentric element rotates about the first rotational axis. The second rotational axis, which is spaced apart from the first rotational axis, also performs a rotational movement about the first rotational axis. Hence, during operation of the power tool the backing pad performs an eccentric or orbital movement in its plane of extension. The possibility for the backing pad to freely rotate about the second rotational axis makes the eccentric or orbital movement a random orbital movement. For example, a pneumatic random orbital power tool of the above-mentioned kind is known from US 2004/0 102 145 A1 and from U.S. Pat. No. 5,319,888. A respective electric power tool is known, for example, from EP 0 694 365 A1.

It is common with all known random orbital power tools that the drive shaft, which is attached to the eccentric element, is guided by one or more bearings in respect to the static body of the power tool in order to allow rotation of the eccentric element about the first rotational axis. The eccentric element, which is attached to the drive shaft in a torque proof manner, has no separate bearings. During rotation about the first rotational axis the eccentric element is only guided by the bearings assigned to the drive shaft. In this conventional construction of the known power tools the eccentric element has a rather large distance from the bearings assigned to the drive shaft. This may not be a problem if the eccentric element simply performed a rotational movement about the first rotational axis without any lateral forces exerting on it. However, this is not the case in random orbital power tools. Due to the rather high weight of the eccentric element (including the backing pad and a counter weight connected thereto) in combination with the eccentric movement about the first rotational axis at rather high speeds (up to 12,000 rpm), there are considerable lateral forces exerting on the eccentric element and the drive shaft to which it is attached. This leads to a rather high moment exerting on the drive shaft and the bearings guiding it.

Furthermore, it is mandatory in the known random orbital power tools that the eccentric element is fixedly attached to the drive shaft in a torque proof manner or forms an integral part of the drive shaft. This implicates a significant limitation in the development of new and the further development of existing power tools.

SUMMARY OF THE INVENTION

Therefore, it is an object of the present invention to propose a power tool of the above-identified kind which overcomes the mentioned drawbacks.

This object is achieved by a power tool comprising the features of claim 1. In particular, it is suggested that in the power tool of the above-identified kind

- at least part of an external circumferential surface of the eccentric element has an at least discrete rotational symmetry in respect to the first rotational axis;
- the power tool comprises at least one first bearing provided between the rotationally symmetric part of the external circumferential surface of the eccentric element and the static body of the power tool so that the eccentric element is guided in respect to the body in a manner rotatable about the first rotational axis; and
- the power tool comprises a mechanical gear arrangement with at least two meshing gear wheels, wherein the gear arrangement is provided functionally between a driving shaft driven by the motor and the eccentric element and wherein at least one of the gear wheels is attached to the eccentric element in a manner adapted for transmitting torque to the eccentric element.

It is an important aspect of the present invention to provide the eccentric element of a random orbital power tool with at least one separate bearing for directly guiding the eccentric element during its rotation about the first rotational axis in respect to the static body. The at least one bearing can absorb the lateral forces directly from the rotating eccentric element (including the backing pad and a counter weight connected thereto). This has the advantage that vibrations of the power tool during its operation resulting from the eccentric element (including the backing pad and a counter weight connected thereto) at high speeds (up to 12,000 rpm) can be significantly reduced. Preferably, the eccentric element is provided with at least two bearings spaced apart from each other in the direction of the first rotational axis, in particular located at opposite ends of the eccentric element along the first rotational axis. This can provide for a large effective distance between two support bearings and allows absorption of larger tilting moments. The at least one bearing is preferably an annular ball race. In particular, it is suggested that at least two inclined support bearings are configured as an O-arrangement. This can further increase the effective distance between the two support bearings and allows absorption of even larger tilting moments.

The external circumferential surface of the eccentric element has a larger diameter than the drive shaft of the prior art power tools. Hence, the at least one bearing provided on the rotationally symmetric part of the external circumferential surface of the eccentric element also has a larger diameter than a bearing provided on the outer surface of the drive shaft in the prior art. Due to the larger diameter, the at least one bearing provided between the eccentric element and the static body can better receive and absorb vibrations from the eccentric element.

The motor for driving the eccentric element may be an electric or a pneumatic motor. The eccentric element is driven indirectly by the motor, for example through a mechanical gear arrangement. The eccentric element is attached to an output of the gear arrangement. The mechanical gear arrangement is provided functionally between a driving shaft driven by the motor and the eccentric element. The driving shaft may be the motor shaft or any other shaft driven by the motor. The mechanical gear arrangement comprises at least two meshing gear wheels, wherein at least one of the gear wheels is attached to the eccentric element in a manner adapted for transmitting torque to the eccentric element. The mechanical gear arrangement is practically integrated into the eccentric element resulting in a very compact eccentric arrangement which allows the construction of very compact, in particular low, power tools. Further, the number of parts of the power tool can be significantly reduced in respect to the prior art.

According to a first preferred embodiment, the mechanical gear arrangement is designed as a planetary gear arrangement comprising a sun gear wheel, a ring gear wheel and a plurality of planetary gear wheels meshing the sun gear wheel and the ring gear wheel. The planetary gear wheels are attached to the eccentric element in a freely rotatable manner. Preferably, the sun gear wheel is attached to the driving shaft in a torque proof manner and the ring gear wheel is attached to the static body of the power tool in a torque proof manner or the ring gear wheel forms an integral part of the static body of the power tool. During operation of the power tool, that is during rotation of the driving shaft, the sun gear wheel rotates, transmits the rotational movement to the planetary gear wheels, which roll over the static ring gear wheel. This leads to a rotation of a planetary carrier of the planetary gear wheels about the first rotational axis. As the eccentric element serves as planetary carrier, the eccentric element is set into motion about the first rotational axis. The rotational speed of the eccentric element depends on the rotational speed of the driving shaft and the sun gear wheel, respectively, and on the number of teeth of the various gear wheels. Preferably, the eccentric element rotates at a lower speed than the sun gear wheel resulting in a higher torque output.

According to another preferred embodiment, the mechanical gear arrangement comprises a first central gear wheel, a plurality of first pinion gear wheels meshing the first central gear wheel, a plurality of second pinion gear wheels each attached to one of the first pinion gear wheels in a torque proof manner or forming an integral part of the respective first pinion gear wheel, and a second central gear wheel meshing the second pinion gear wheels. The second central gear wheel is attached to the eccentric element in a torque proof manner or the second central gear wheel forms an integral part of the eccentric element. Preferably, the first central gear wheel is attached to the driving shaft in a torque proof manner or forms an integral part of the driving shaft, and each of the plurality of first pinion gear wheels together with the respective second pinion gear wheel are attached to the body of the power tool in a freely rotatable manner. The first and second central gear wheels are located concentrically within the gear arrangement. During operation of the power tool, that is during rotation of the driving shaft, the first central gear wheel rotates about a rotational axis coaxial to the first rotational axis, makes the first pinion gear wheels rotate, which make the second pinion gear wheels rotate, which in turn set the second central gear wheel and the eccentric element into motion about the first rotational axis. The fact that the first and second pinion gear wheels are attached to the body of the power tool in a freely rotatable manner, provokes rotation of the second central gear wheel together with the eccentric element to which it is fixedly attached. The rotational speed of the eccentric element depends on the rotational speed of the driving shaft and the first central gear wheel, respectively, and on the number of teeth of the various gear wheels. Preferably, the eccentric element rotates at a lower speed than the first central gear wheel resulting in a higher torque output.

According to yet another preferred embodiment of the invention it is suggested that the mechanical gear arrangement is designed as a bevel gear arrangement comprising a bevel pinion wheel and a crown wheel meshing the bevel pinion wheel. The crown wheel is attached to the eccentric element in a torque proof manner or the crown wheel forms an integral part of the eccentric element. Preferably, the bevel pinion wheel is attached to the driving shaft in a torque proof manner or forms an integral part of the driving shaft. In this embodiment the rotational axis of the driving shaft runs at an angle in respect to the first rotational axis. Preferably, the angle is around 90°. This gear arrangement is particularly adapted for realizing angular power tools, in particular angular grinders and angular polishers. During operation of the power tool, that is during rotation of the driving shaft, the bevel pinion wheel rotates about a rotational axis extending in an angle in respect to the first rotational axis and sets the crown wheel and the eccentric element into motion about the first rotational axis. The rotational speed of the eccentric element depends on the rotational speed of the driving shaft and the bevel pinion wheel, respectively, and on the number of teeth of the bevel pinion wheel and the crown wheel. Preferably, the eccentric element rotates at a lower speed than the first central gear wheel resulting in a higher torque output.

In order to allow a direct guiding of the eccentric element by means of the at least one bearing, at least part of the external circumferential surface of the eccentric element, where the at least one bearing is provided, has an at least discrete rotational symmetry in respect to the first rotational axis. Rotational symmetry of order n, also called n-fold rotational symmetry, or discrete rotational symmetry of the $n^{th}$ order of an object, with respect to a particular point (in 2D) or axis (in 3D) means that rotation of the object by an angle of 360°/n does not change the object. "1-fold" symmetry is no symmetry because all objects look alike after a rotation of 360°. Preferably, the rotationally symmetric part of the external circumferential surface of the eccentric element has a rotational symmetry in respect to a rotation about the first rotational axis by any angle (so-called circular symmetry). This means that the rotationally symmetric part of the external circumferential surface of the eccentric element has a cylindrical form, wherein the cylinder axis corresponds to the first rotational axis of the eccentric element. The at least one bearing is provided on the cylindrical part of the eccentric element and guides the eccentric element in respect to the static body (e.g. the housing or a separate chassis attached to the housing) of the power tool.

According to a preferred embodiment of the present invention it is suggested that the eccentric element comprises an eccentric seat where a fulcrum pin is inserted and guided in a freely rotatable manner about the second rotational axis. The fulcrum pin comprises attachment means, e.g. an enlarged head portion, to which the backing pad may be releasably attached. To this end, a recess is provided on a top surface of the backing pad, wherein the internal circumferential form of the recess corresponds to the external circumferential form of the attachment means. The attachment means are held in the recess of the backing pad in an axial direction by means of a screw or magnetic force. Preferably, the eccentric element comprises at least one second bearing at the eccentric seat and acting between the eccentric element and the fulcrum pin so that the fulcrum pin is guided in respect to the eccentric element in a freely rotatable manner about the second rotational axis. Alternatively, the fulcrum pin may also comprise an external thread which corresponds to an internal thread provided in a bore on the top surface of the backing pad. In this way, the backing pad may be attached to the fulcrum pin by screwing the fulcrum pin into the bore of the backing pad.

According to another preferred embodiment of the present invention it is suggested that the first bearing or at least one of the first bearings is located on the rotationally symmetric part of the external circumferential surface of the eccentric element in such a manner that it surrounds at least part of the at least one second bearing. With other words, the first bearing or at least one of the first bearings and the second bearing are located in the same horizontal plane extending perpendicular to the first rotational axis and parallel to an extension plane of the backing pad. This provides for a particularly good and effective absorption of the lateral forces introduced into the eccentric element by the backing pad through the fulcrum pin, which is guided in the at least one second bearing.

According to a preferred embodiment of the present invention, it is suggested that the motor of the power tool is an electric motor comprising a stator with electric windings and a rotor with permanent magnets. The electric motor is preferably an electrically commutated brushless motor. Preferably, the electric motor is of a radial type with the magnetic field between the electric stator windings and the permanent magnets of the rotor extending in an essentially radial direction. The electric motor can be a so-called outrunner and a so-called inrunner.

Furthermore, according to another preferred embodiment of the present invention it is suggested that the power tool comprises a fan or turbine attached to or forming an integral part of the eccentric element on a part of the eccentric element directed towards the backing pad connected thereto. Such a turbine comprises a plurality of fins, which upon rotation of the turbine about the first rotational axis create a radial or an axial air flow. The air flow can be used for cooling internal components of the power tool (e.g. electronic components such as an electric motor, an electronic control unit, electronic valves and switches, electric inductors or the like, or pneumatic components such as a pneumatic motor, pneumatic valves and switches) and/or for aspiring dust and other small particles (e.g. grinding dust, polishing dust, particles from a polishing agent) from the surface currently worked by the power tool and/or from the surrounding environment and for conveying the aspired dust and other small particles to a filter unit or cartridge attached to the power tool or to an external dust extraction system (e.g. a vacuum cleaner). This embodiment has the advantage that the unit comprising the eccentric element, the mechanical gear arrangement and the turbine is particularly compact and has a flat design. The unit integrates a plurality of different components in a very small space.

To yet another preferred embodiment of the present invention, it is suggested that the power tool comprises a counter weight attached to or forming an integral part of the eccentric element or the turbine on a part of the eccentric element directed towards the backing pad connected thereto. The counter weight can be a separate element which is attached and fixed to the eccentric element, for example by means of a screw. Alternatively, the counter weight can be formed as an integral part of the eccentric element or the turbine, if a turbine is present.

BRIEF SUMMARY OF THE DRAWING

Further features and advantages of the present invention will be described in more detail with reference to the accompanying drawings. These show.

DETAILED DESCRIPTION OF THE BEST MODE OF THE INVENTION

Figure 1:
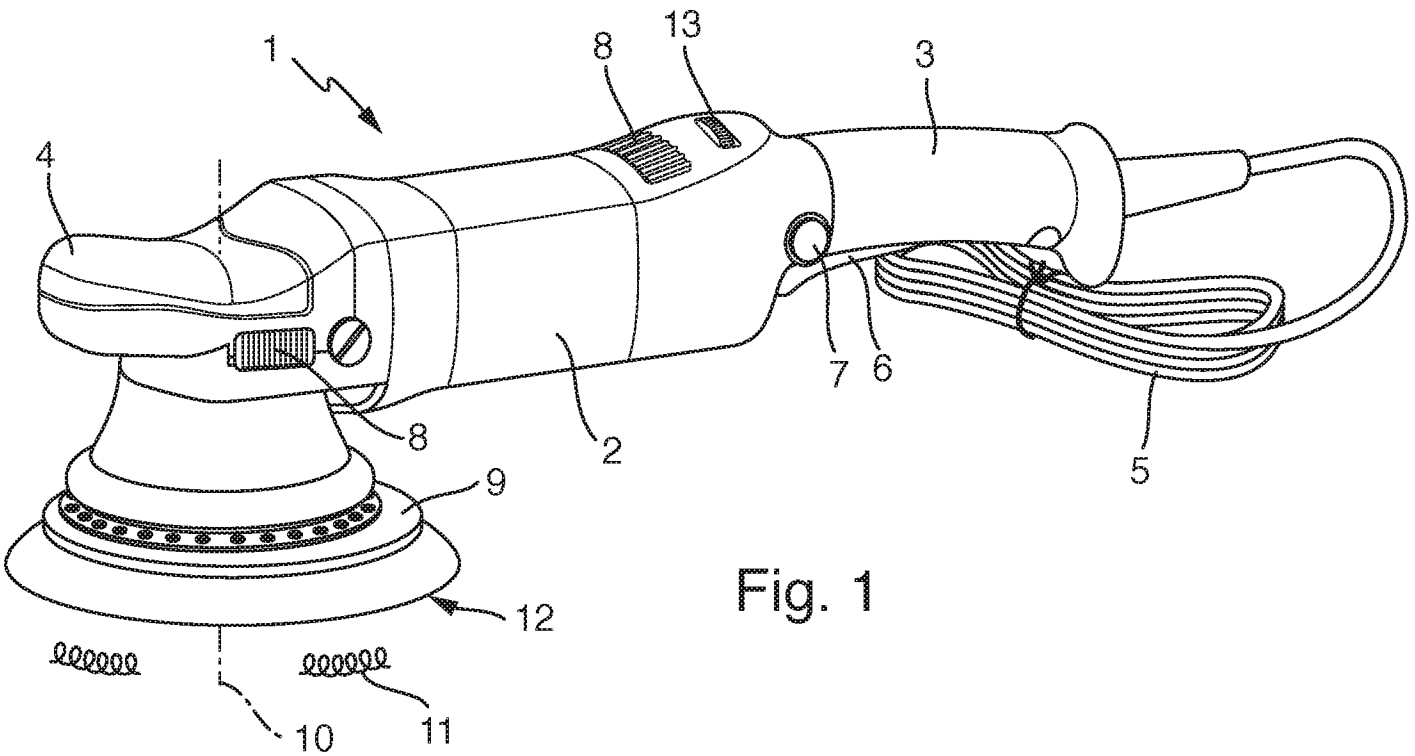
FIG. 1 an example of a hand-held and hand-guided random orbital power tool according to the present invention in a perspective view.
Figure 2:
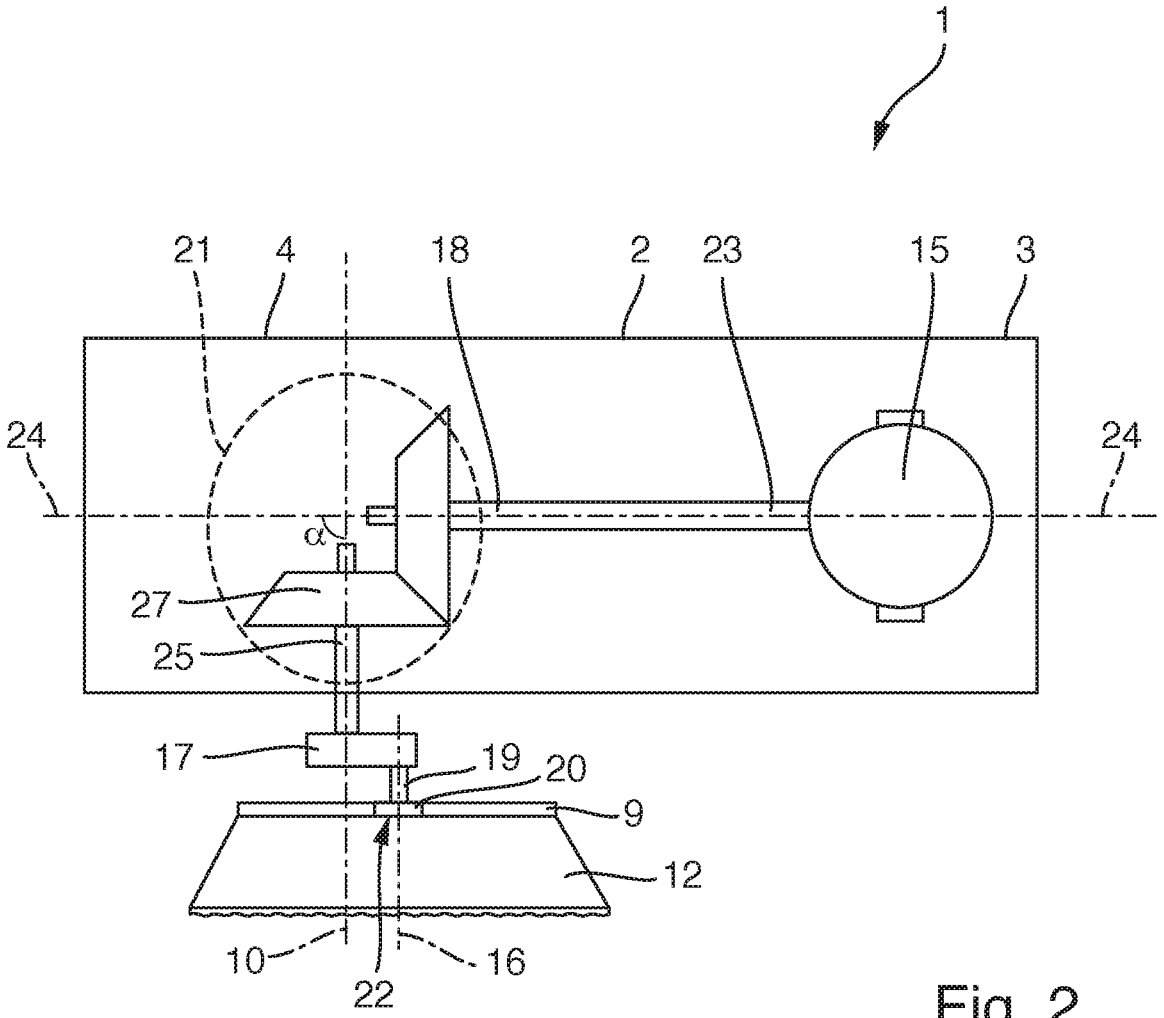
FIG. 2 a schematic longitudinal section through the power tool of FIG. 1.

FIG. 1 shows an example of a hand-held and hand-guided electric power tool 1 according to the present invention in a perspective view. FIG. 2 shows a schematic longitudinal section through the power tool 1 of FIG. 1. The power tool 1 is embodied as a random orbital polishing machine (or polisher). Of course, the power tool 1 cold also be embodied as a random orbital sanding machine (or sander) or any other power tool 1 with a backing pad performing a random orbital movement during operation of the power tool 1. The polisher 1 has a housing 2, essentially made of a plastic material. The housing 2 is provided with a handle 3 at its rear end and a grip 4 at its front end in order to allow a user of the tool 1 to hold the tool 1 with both hands and apply a certain amount of downward pressure on the grip 4 during the intended use of the tool 1. An electric power supply line 5 with an electric plug at its distal end exits the housing 2 at the rear end of the handle 3. At the bottom side of the handle 3 a switch 6 is provided for activating and deactivating the power tool 1. The switch 6 can be continuously held in its activated position by means of a lateral push button 7. The power tool 1 can be provided with adjustment means 13 (e.g. a knurled wheel for controlling a rotary potentiometer) for setting the rotational speed of the tool's electric motor 15 (see FIG. 2) to a desired value. The housing 2 can be provided with cooling openings 8 for allowing heat from electronic components and/or the electric motor 15 both located inside the housing 2 to dissipate into the environment and/or for allowing cooling air from the environment to enter into the housing 2.

The power tool 1 shown in FIG. 1 has an electric motor 15. Alternatively, the power tool 1 could also have a pneumatic motor. In that case instead of the electric cable 5 the power tool 1 could be supplied with high pressure air for driving the pneumatic motor through a pneumatic tube or the like. The electric motor 15 is preferably of the brushless type. Instead of the connection of the power tool 1 to a mains power supply by means of the electric cable 5, the tool 1 could additionally or alternatively be equipped with a rechargeable or exchangeable battery (not shown) located at least partially inside the housing 2. In that case the electric energy for driving the electric motor 15 and for operating the other electronic components of the tool 1 would be provided by the battery. If despite the presence of a battery the electric cable 5 was still present, the battery could be charged with an electric current from the mains power supply before, during or after operation of the power tool 1. The presence of a battery would allow the use of an electric motor 15 which is not operated at the mains power supply voltage (230V in Europe or 110V in the US and other countries), but rather at a reduced voltage of, for example, 12V, 24V, 36V or 42V depending on the voltage provided by the battery.

The power tool 1 has a plate-like backing pad 9 rotatable about a first rotational axis 10. In particular, the backing pad 9 of the tool 1 shown in FIG. 1 performs a random orbital rotational movement 11 about the first rotational axis 10. With the random orbital movement 11 the backing pad 9 performs a first rotational movement about the first rotational axis 10. Spaced apart from the first rotational axis 10 a second rotational axis 16 (see FIG. 2) is defined, about which the backing pad 9 is freely rotatable independently from the rotation of the backing pad 9 about the first rotational axis 10. The second axis 16 runs through a balance point of the backing pad 9 and parallel to the first rotational axis 10. The random orbital movement 11 is realized by means of an eccentric element 17, which is directly or indirectly driven by the motor 15 and during operation of the tool 1 performs a rotational motion about the first rotational axis 10. A fulcrum pin 19 is held in the eccentric element 17 freely rotatable about the second rotational axis 16. An attachment member 20 (e.g. an enlarged head portion) of the fulcrum pin 19 is inserted into a recess 22 provided in a top surface of the backing pad 9 and attached thereto in a releasable manner, e.g. by means of a screw (not shown) or by means of magnetic force. The eccentric element 17 may be directly attached to at least one gear wheel of a mechanical gear arrangement 21 in a manner adapted to transmit a torque to the eccentric element 17. The mechanical gear arrangement 21 is provided functionally between the driving shaft 18 and the eccentric element 17, thereby transmitting a rotational movement as well as torque from the driving shaft 18 to the eccentric element 17.

The backing pad 9 is made of a rigid material, preferably a plastic material, which on the one hand is rigid enough to carry and support a tool accessory 12 for performing a desired work on a surface (e.g. polishing or sanding the surface of a vehicle body, a boat or an aircraft hull) during the intended use of the power tool 1 and to apply a force to the backing pad 9 and the tool accessory 12 in a direction downwards and essentially parallel to the first rotational axis 10, and which on the other hand is flexible enough to avoid damage or scratching of the surface to be worked by the backing pad 9 or the tool accessory 12, respectively. For example, in the case where the power tool 1 is a polisher, the tool accessory 12 may be a polishing material comprising but not limited to a foam or sponge pad, a microfiber pad, and a real or synthetic lambs' wool pad. In FIG. 1 the tool accessory 12 is embodied as a foam or sponge pad. In the case where the power tool 1 is a sander, the tool accessory 12 may be a sanding or grinding material comprising but not limited to a sanding paper, and a sanding textile or fabric. The backing pad 9 and the tool accessory 12, respectively, preferably have a circular form in a view parallel to the rotational axis 16.

The bottom surface of the backing pad 9 is provided with means for releasably attaching the tool accessory 12 thereto. The attachment means can comprise a first layer of a hook-and-loop fastener (or Velcro®) on the bottom surface of the backing pad 9, wherein a top surface of the tool accessory 12 is provided with a corresponding second layer of the hook-and-loop fastener. The two layers of the hook-and-loop fastener may interact with one another in order to releasably but safely fix the tool accessory 12 to the bottom surface of the backing pad 9. Of course, with other types of power tools 1, the backing pad 9 and the tool accessory 12 may be embodied differently.

Now turning to the inside of the power tool 1 shown in FIG. 2, it can be seen that the electric motor 15 does not directly drive the eccentric element 17. Rather, a motor shaft 23 of the motor 15 or a driving shaft 18, in this case directly coupled to the motor shaft 23 in a torque proof manner, constitutes an input shaft for a mechanical bevel gear arrangement 21. A rotational output motion of an output gear wheel 27 of the bevel gear arrangement 21 is transmitted to the eccentric element 17. The bevel gear arrangement 21 serves for translating a rotational movement of the motor shaft 23 about a longitudinal axis 24 into a rotational movement of the eccentric element 17 about the first rotational axis 10. The rotational speeds of the motor shaft 23 and of the eccentric element 17 may be the same (the bevel gear arrangement 21 has a gear ratio of 1) or may differ from one another (the bevel gear arrangement 21 has a gear ratio≠1). The bevel gear arrangement 21 is necessary because the shown power tool 1 is an angular polisher, where the longitudinal axis 24 of the motor shaft 23 runs in a certain angle $\alpha$ (preferably between 90° and below 180°) in respect to the first rotational axis 10 of the eccentric element 17. In the shown embodiment the angle is exactly 90°. Of course, in other power tools 1 it could well be possible that the two axes 24, 10 are parallel or coaxial and, therefore, that there is no need for a bevel gear arrangement 21.

The present invention in particular refers to a special design of the eccentric element 17. In the prior art, the eccentric element 17 is fixedly attached to a drive shaft 25 in a torque proof manner. The drive shaft 25 is guided by one or more bearings in respect to a static body 31 (see FIGS. 3 to 8) of the power tool 1. The static body 31 may be fixed to the housing 2 of the power tool 1 or could form an integral part of the housing 2 itself. The bearings allow a rotation of the drive shaft 25 about the first rotational axis 10. The eccentric element 17 has no separate bearings. During rotation about the first rotational axis 10 the eccentric element 17 is only guided by the bearings assigned to the drive shaft 25. In this conventional construction of the known power tools 1 the eccentric element 17 is spaced apart rather far from the bearings assigned to the drive shaft 25. Due to the rather high weight of the eccentric element 17 (including the backing pad 9, the tool accessory 12 and a counter weight connected thereto) in combination with the eccentric movement about the first rotational axis 10 at rather high speeds (up to 12,000 rpm), there are considerable lateral forces exerting on the eccentric element 17 and moments exerted on the drive shaft 25 to which it is attached. This may cause considerable vibrations and leads to a rather high mechanical load exerted on the drive shaft 25 and the respective bearings guiding it.

These drawbacks are overcome by the power tool 1 according to the present invention and its special eccentric element 17. In particular, at least one gear wheel 27 of the mechanical gear arrangement 21 is attached to the eccentric element 17 in such a manner that a torque can be transmitted to the eccentric element 17. The at least one gear wheel 27 may be attached to the eccentric element 17 in a torque proof manner coaxially in respect to the first rotational axis 10 or in a manner freely rotatable about a rotational axis extending parallel to and laterally displaced from the first rotational axis 10. In this manner, the gear arrangement 21 is integrated at least partially in the eccentric element 17 resulting in a particularly compact eccentric arrangement (comprising the eccentric element 17 and the mechanical gear arrangement 21) and consequently also in a very compact power tool 1, in particular having a flat construction. In the invention the drive shaft 25 of the prior art power tools 1 provided between the gear arrangement 21 and the eccentric element 17 is omitted.

Figure 3:
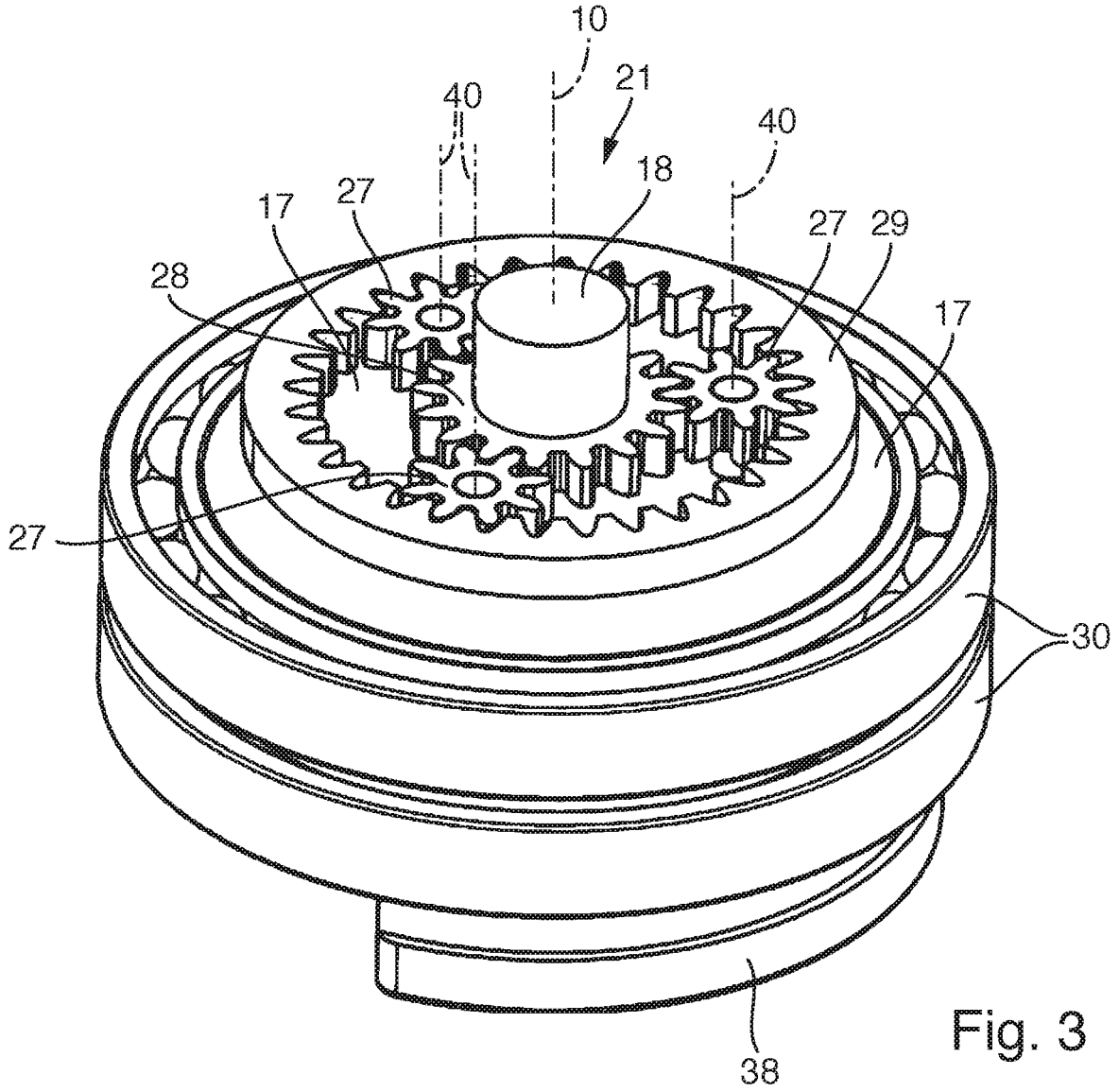
FIG. 3 a perspective view of an eccentric arrangement of the power tool of FIG. 1 according to a first embodiment, comprising a mechanical gear arrangement and a counter weight.
Figure 4:
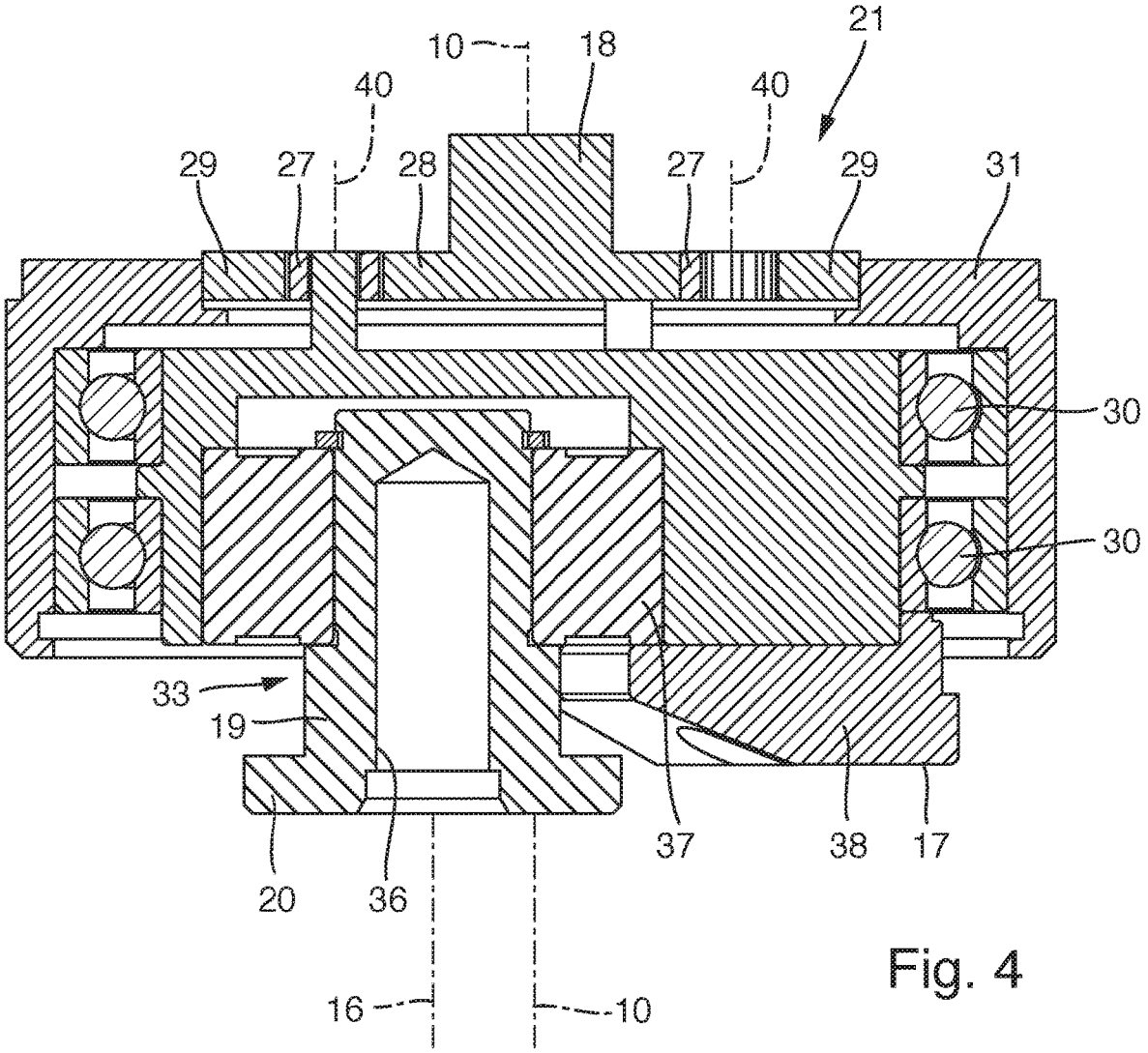
FIG. 4 a vertical sectional view of the eccentric arrangement of FIG. 3.

Various embodiments of an eccentric arrangement are described in further detail hereinafter with reference to FIGS. 3 to 8. According to a first preferred embodiment shown in FIGS. 3 and 4, the mechanical gear arrangement 21 is designed as a planetary gear arrangement comprising a sun gear wheel 28, a ring gear wheel 29 and a plurality of planetary gear wheels 27 meshing the sun gear wheel 28 as well as the ring gear wheel 29. The planetary gear wheels 27 are attached to the eccentric element 17 in a manner freely rotatable about rotational axes 40. Preferably, the sun gear wheel 28 is attached to the driving shaft 18 in a torque proof manner. Alternatively, the sun gear wheel 28 may also form an integral part of the driving shaft 18. The ring gear wheel 29 is preferably attached to the static body 31 of the power tool 1 in a torque proof manner. Alternatively, the ring gear wheel 29 may also form an integral part of the static body 31. During operation of the power tool 1, that is during rotation of the driving shaft 18 about the first rotational axis 10, the sun gear wheel 28 rotates, transmits the rotational movement to the planetary gear wheels 27, which roll over the static ring gear wheel 29. This leads to a rotation of a planetary carrier of the planetary gear wheels 27 about the first rotational axis 10. As the eccentric element 17 serves as planetary carrier, the eccentric element 17 is set into motion about the first rotational axis 10. The rotational speed of the eccentric element 17 depends on the rotational speed of the driving shaft 18 and the sun gear wheel 28, respectively, and on the number of teeth of the various gear wheels 27, 28, 29. Preferably, the eccentric element 17 rotates at a lower speed than the sun gear wheel 28 resulting in a higher torque output. In FIG. 3 the static body 31 of the power tool 1 is not shown.

According to the invention it is suggested that at least part of an external circumferential surface of the eccentric element 17 has an at least discrete rotational symmetry in respect to the first rotational axis 10; and that the power tool 1 comprises at least one first bearing 30 provided between the rotationally symmetric part of the external circumferential surface of the eccentric element 17 and the static body 31 of the power tool 1 (see FIG. 4) so that the eccentric element 17 is guided in respect to the body 31 in a manner rotatable about the first rotational axis 10.

An important aspect of the present invention is to provide the eccentric element 17 of a random orbital power tool 1 with at least one separate bearing 30 for directly guiding the eccentric element 17 during its rotation about the first rotational axis 10. The bearing 30 can absorb the lateral forces directly from the rotating eccentric element 17 (including the backing pad 9, the tool accessory 12 and a counter weight connected thereto). This has the advantage that vibrations of the power tool 1 during its operation resulting from the eccentric element 17 (including the backing pad 9, the tool accessory 12 and a counter weight connected thereto) at high speeds (up to 12,000 rpm) can be significantly reduced. Preferably, the eccentric element 17 is provided with at least two bearings 30 spaced apart from each other in the direction of the first rotational axis 10, in particular located at opposite ends of the eccentric element 17 along the first rotational axis 10. The bearings 30 are preferably embodied as annular ball races. In particular, it is suggested that the two bearings 30 are inclined support bearings configured as an O-arrangement. This can increase the effective distance between two bearings 30 and allows absorption of larger tilting moments.

In order to allow a direct guiding of the eccentric element 17 by means of the bearings 30, at least that part of the external circumferential surface of the eccentric element 17, where the bearings 30 are provided, has an at least discrete rotational symmetry in respect to the first rotational axis 10. Preferably, the rotationally symmetric part of the external circumferential surface of the eccentric element 17 has a rotational symmetry in respect to a rotation about the first rotational axis 10 by any angle (so-called circular symmetry). This means that the rotationally symmetric part of the external circumferential surface of the eccentric element 17 has a cylindrical form, wherein the cylinder axis corresponds to the first rotational axis 10 of the eccentric element 17. The bearings 30 are provided on the cylindrical part of the eccentric element 17 and guide the eccentric element 17 in respect to the static body 31 (e.g. the housing or a separate chassis attached to the housing) of the power tool 1.

The eccentric element 17 comprises an eccentric seat 33 where a fulcrum pin 19 is inserted and guided in a freely rotatable manner about the second rotational axis 16. The fulcrum pin 19 comprises attachment means 20, e.g. an enlarged head portion, to which the backing pad 9 may be releasably attached. To this end, the recess 22 is provided in the top surface of the backing pad 9, wherein the internal circumferential form of the recess 22 corresponds to the external circumferential form of the attachment means 20. The fulcrum pin 19 has a threaded bore 36, into which a screw can be screwed after insertion of the attachment means 20 into the recess 22 of the backing pad 9, thereby releasably fixing the backing pad 9 to the fulcrum pin 19. Preferably, the eccentric element 17 comprises at least one second bearing 37 at the eccentric seat 33 and provided between the eccentric element 17 and the fulcrum pin 19 so that the fulcrum pin 19 is guided in respect to the eccentric element 17 in a freely rotatable manner about the second rotational axis 16. The second bearing 37 may also be embodied as an annular ball race.

At least one of the first bearings 30 is preferably located on the rotationally symmetric part of the external circumferential surface of the eccentric element 17 in such a manner that it surrounds at least part of the eccentric seat 33 and the second bearing 37, respectively. With other words, the first bearing 30 located towards the bottom of the eccentric element 17 and the second bearing 37 are located in the same horizontal plane. This provides for a particularly good and effective absorption of the lateral forces introduced into the eccentric element 17 by the backing pad 9 through the fulcrum pin 19, which is guided in the second bearing 37. A separate counterweight 38 may be provided on a side of the first rotational axis 10 opposite to the eccentric seat 33. The counterweight 38 may be an integral part of the eccentric element 17. Preferably, the counterweight 38 is a part separate from the eccentric element 17 and attached thereto, for example, by means of one or more screws (not shown).

Figure 5:
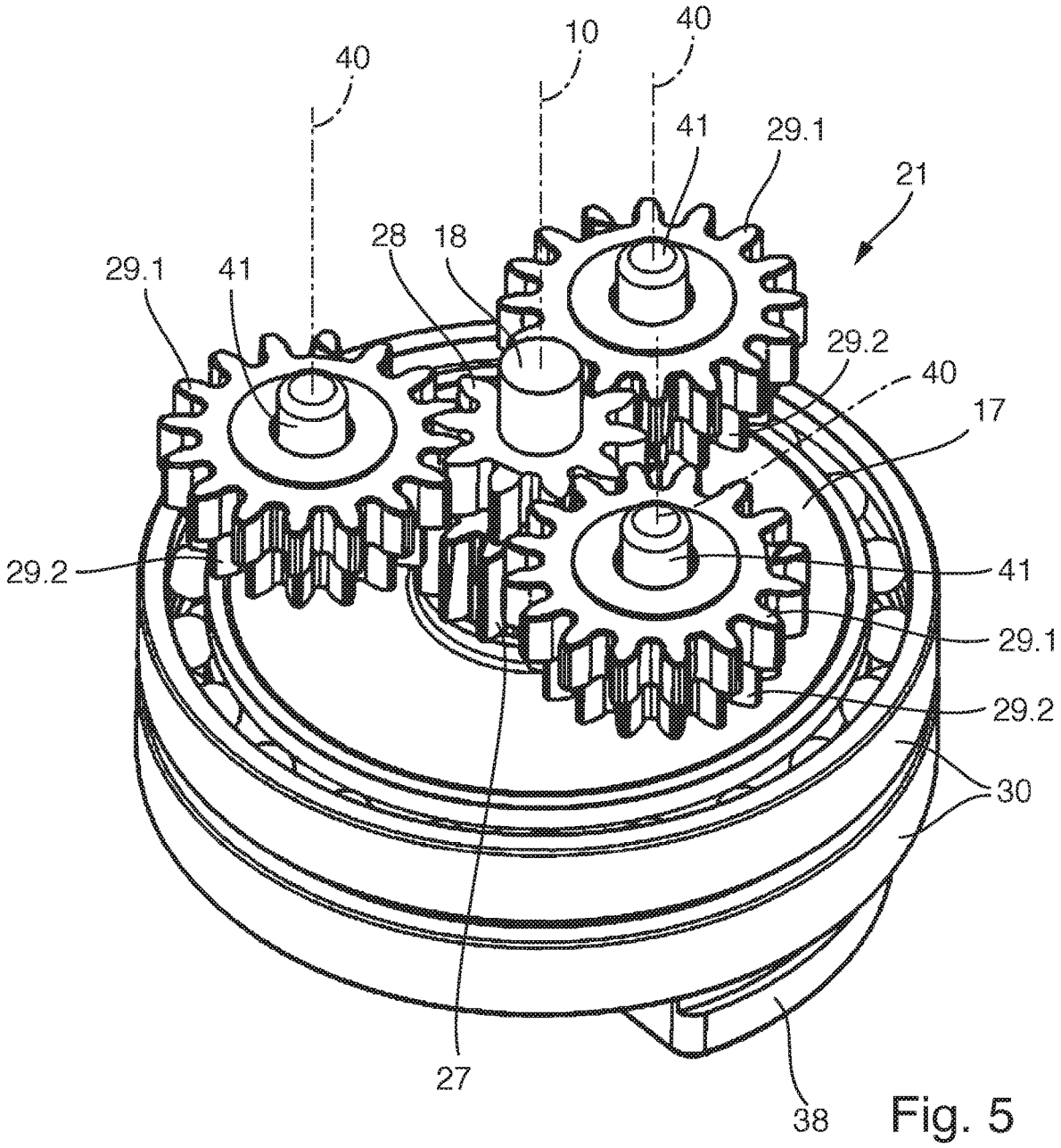
FIG. 5 a perspective view of an eccentric arrangement of the power tool of FIG. 1 according to a second embodiment, comprising mechanical gear arrangement and a counter weight.
Figure 6:
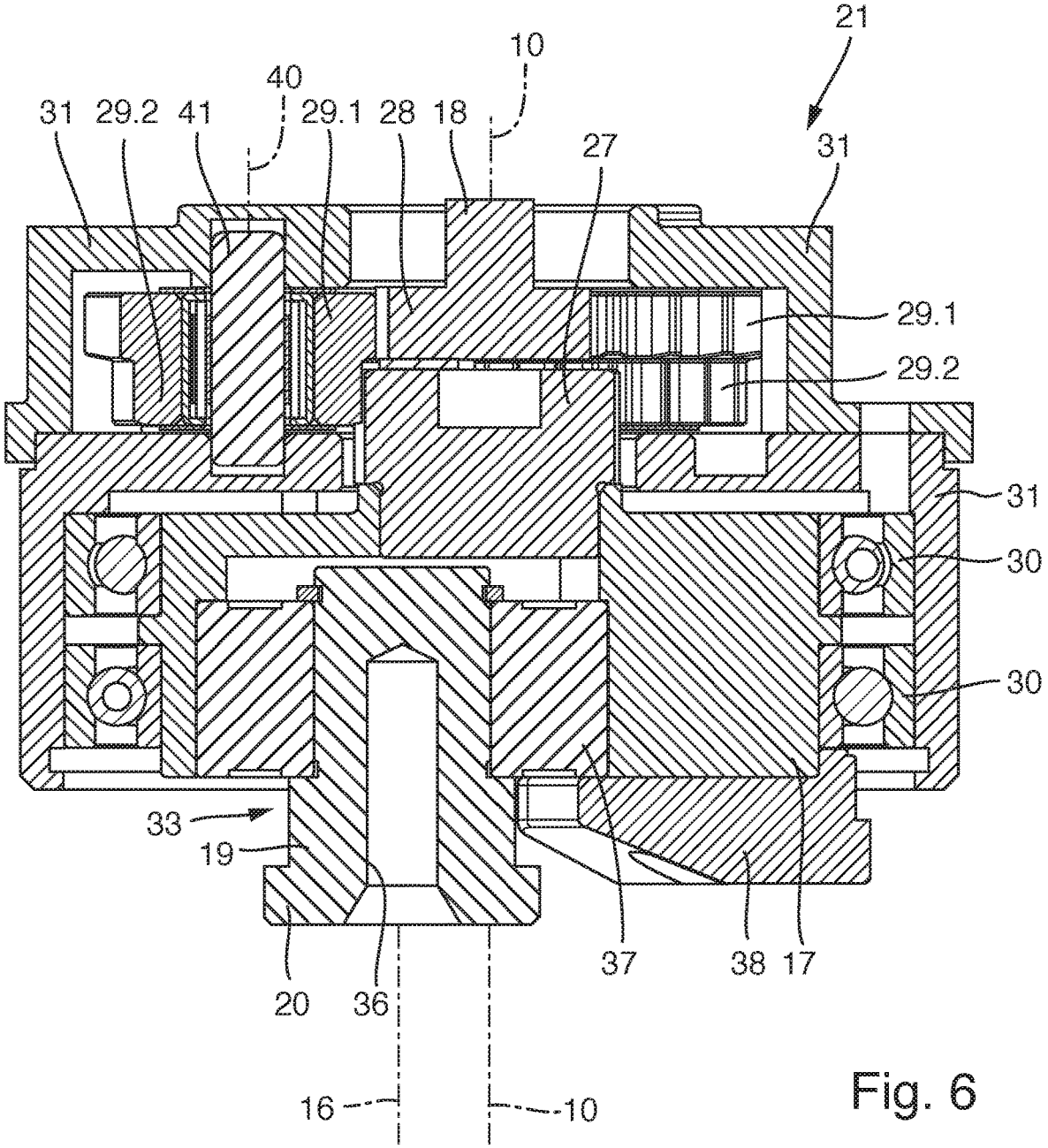
FIG. 6 a vertical sectional view of the eccentric arrangement of FIG. 5.

According to another preferred embodiment shown in FIGS. 5 and 6, the mechanical gear arrangement 21 comprises a first central gear wheel 28, a plurality of first pinion gear wheels 29.1 meshing the first central gear wheel 28, a plurality of second pinion gear wheels 29.2 each attached to one of the first pinion gear wheels 29.1 in a torque proof manner or (as in the present case) forming an integral part of the respective first pinion gear wheel 29.1, and a second central gear wheel 27 meshing the second pinion gear wheels 29.2. The second central gear wheel 27 is attached to the eccentric element 17 in a torque proof manner. Alternatively, the second central gear wheel 27 could also form an integral part of the eccentric element 17. Preferably, the first central gear wheel 28 is attached to the driving shaft 18 in a torque proof manner. Alternatively, it could also form an integral part of the driving shaft 18. Each of the plurality of first pinion gear wheels 29.1 together with the respective second pinion gear wheel 29.2 are attached to the body 31 of the power tool 1 in a freely rotatable manner about a rotational axis 40 extending essentially parallel to the first rotational axis 10. To this end, guiding pins 41 are attached to the body 31 and passing through a central opening of the first and second pinion gear wheels 29.1, 29.2. The first and second central gear wheels 27, 28 are located concentrically within the gear arrangement 21. During operation of the power tool 1, that is during rotation of the driving shaft 18, the first central gear wheel 28 rotates about a rotational axis coaxial to the first rotational axis 10, makes the first pinion gear wheels 29.1 rotate, which force the second pinion gear wheels 29.2 into rotation, which in turn set the second central gear wheel 27 and the eccentric element 17 into motion about the first rotational axis 10. The fact that the first and second pinion gear wheels 29.1, 29.2 are attached to the body 31 of the power tool 1 in a freely rotatable manner, provokes rotation of the second central gear wheel 27 together with the eccentric element 17 to which it is fixedly attached. The rotational speed of the eccentric element 17 depends on the rotational speed of the driving shaft 18 and the first central gear wheel 28, respectively, and on the number of teeth of the various gear wheels 27, 28, 29.1, 29.2. Preferably, the eccentric element 17 rotates at a lower speed than the first central gear wheel 28 resulting in a higher torque output.

Figure 7:
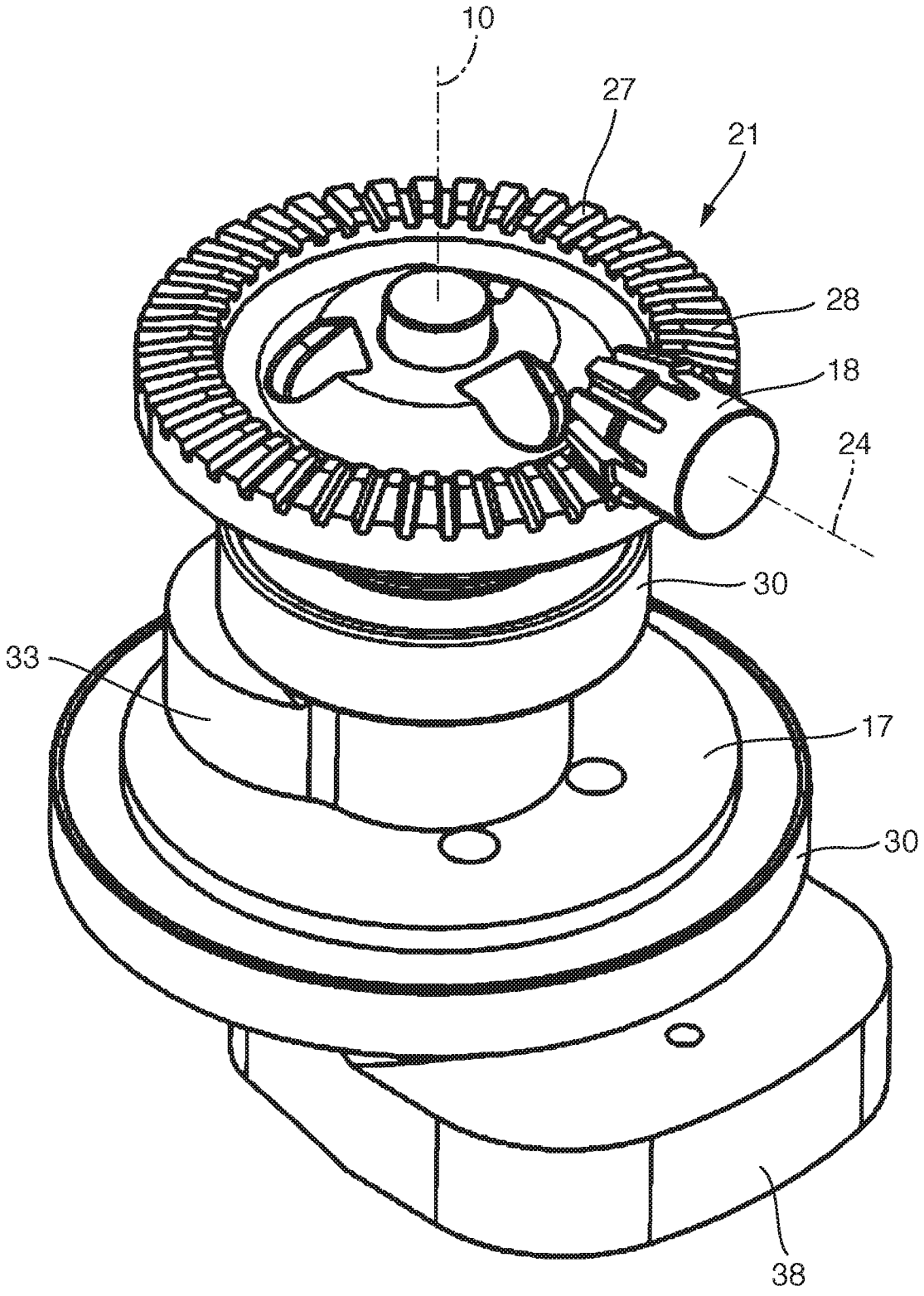
FIG. 7 a perspective view of an eccentric arrangement of the power tool of FIG. 1 according to a third embodiment, comprising a mechanical gear arrangement and a counter weight.
Figure 8:
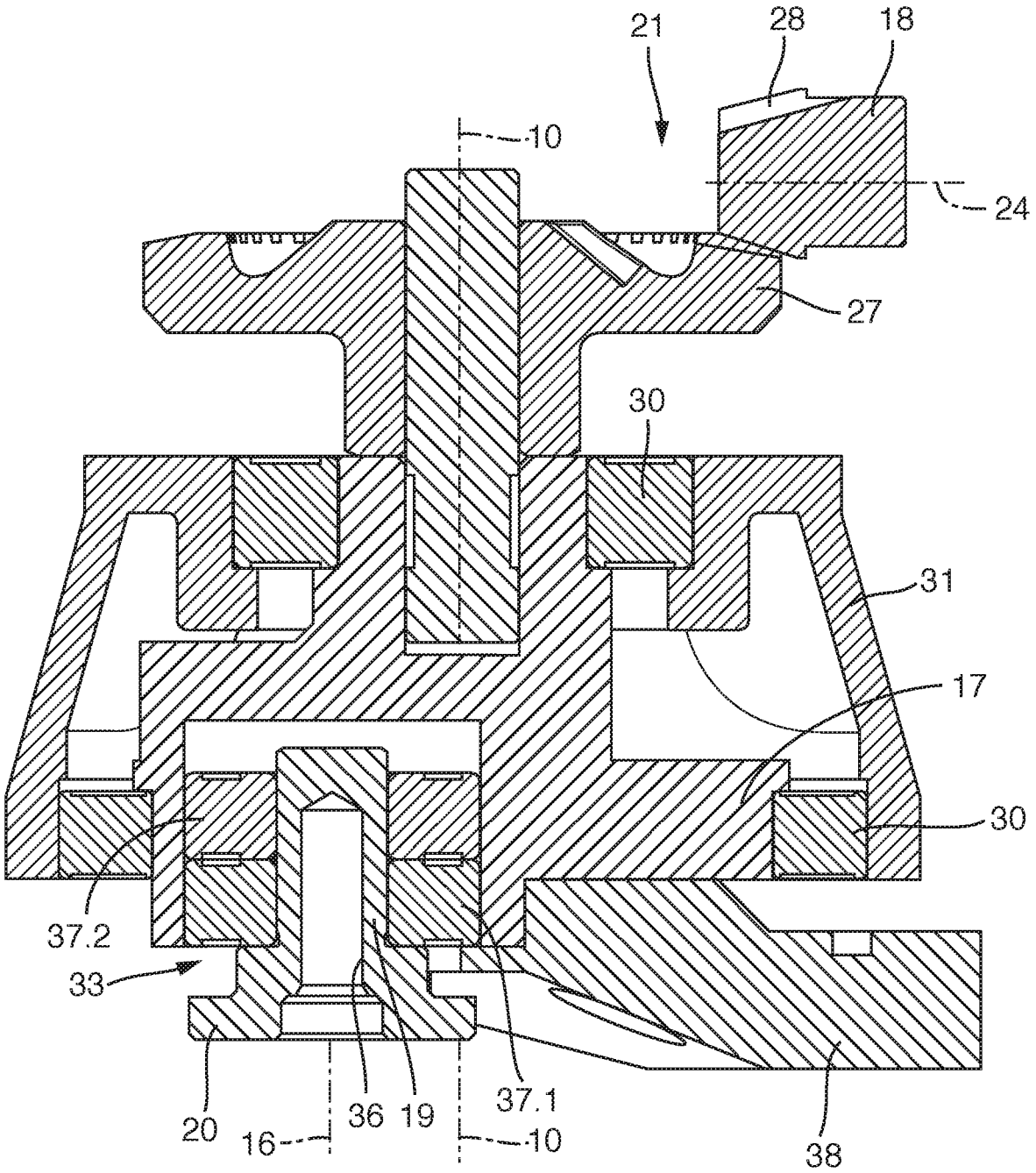
FIG. 8 a vertical sectional view of the eccentric arrangement of FIG. 7.

According to yet another preferred embodiment of the invention shown in FIGS. 7 and 8 it is suggested that the mechanical gear arrangement 21 is designed as a bevel gear arrangement comprising a bevel pinion wheel 28 and a crown wheel 27 meshing the bevel pinion wheel 28. The crown wheel 27 is attached to the eccentric element 17 in a torque proof manner. Alternatively, the crown wheel 27 may also form an integral part of the eccentric element 17. Preferably, the bevel pinion wheel 28 is attached to the driving shaft 18 in a torque proof manner or (like in the present example) forms an integral part of the driving shaft 18. In this embodiment the rotational axis 24 of the driving shaft 18 runs at an angle in respect to the first rotational axis 10. Preferably, the angle is around 90°. This gear arrangement 21 is particularly adapted for realizing angular power tools 1, in particular angular grinders and angular polishers like the one shown in FIGS. 1 and 2. During operation of the power tool 1, that is during rotation of the driving shaft 18, the bevel pinion wheel 28 rotates about the rotational axis 24 extending in an angle in respect to the first rotational axis 10 and sets the crown wheel 27 and the eccentric element 27 into motion about the first rotational axis 10. The rotational speed of the eccentric element 17 depends on the rotational speed of the driving shaft 18 and the bevel pinion wheel 28, respectively, and on the number of teeth of the bevel pinion wheel 28 and the crown wheel 27. Preferably, the eccentric element 17 rotates at a lower speed than the first central gear wheel 28 resulting in a higher torque output. In this embodiment, the eccentric seat 33 is provided with two separate second bearings 37.1 and 37.2.

The invention claimed is:

1. A power tool, including a hand-held and hand-guided random orbital polishing or sanding power tool, comprising:

a static body, a motor, an eccentric element driven by the motor and performing a rotational movement about a first rotational axis, and a plate-like backing pad connected to the eccentric element in a manner freely rotatable about a second rotational axis, first and second rotational axes extending substantially parallel to one another and being spaced apart from one another, at least part of an external circumferential surface of the eccentric element having an at least discrete rotational symmetry in respect to the first rotational axis so as to form a rotationally symmetric part of the eccentric element;

the power tool having at least one first bearing provided between the rotationally symmetric part of the external circumferential surface of the eccentric element and the static body of the power tool so that the eccentric element is guided in respect to the static body in a manner rotatable about the first rotational axis; and the power tool having a mechanical gear arrangement with at least two meshing gear wheels, the mechanical gear arrangement being provided functionally between a driving shaft driven by the motor and the eccentric element, and at least one of the at least two meshing gear wheels being attached to the eccentric element in a manner adapted for transmitting torque to the eccentric element;

wherein the mechanical gear arrangement is designed as a planetary gear arrangement having a sun gear wheel, a ring gear wheel and a plurality of planetary gear wheels meshing the sun gear wheel and the ring gear wheel, the plurality of planetary gear wheels being attached to the eccentric element in a freely rotatable manner; and the sun gear wheel is attached to the driving shaft in a torque proof manner or forms an integral part of the driving shaft, and the ring gear wheel forms an integral part of the static body of the power tool.

2. The power tool according to claim 1, wherein the rotationally symmetric part of the external circumferential surface of the eccentric element has a rotational symmetry in respect to a rotation about the first rotational axis by any angle.

3. The power tool according to claim 2, wherein the at least one first bearing is a ball race.

4. The power tool according to claim 2, wherein the at least one first bearing comprises at least two first bearings provided between the rotationally symmetric part of the external circumferential surface of the eccentric element and the static body of the power tool, the at least two first bearings being spaced apart from each other in a direction along the first rotational axis.

5. The power tool according to claim 2, wherein the eccentric element comprises a fulcrum pin connected to the eccentric element in a freely rotatable manner about the second rotational axis; and the fulcrum pin comprises an enlarged head portion adapted for insertion into a respective recess provided on a top surface of the plate-like backing pad, the enlarged head portion configured for releasable attachment of the plate-like backing pad to the fulcrum pin.

6. The power tool according to claim 2, wherein the power tool comprises a turbine attached to, or forming an integral part of, the eccentric element on a side of the eccentric element directed towards the backing pad connected thereto.

7. The power tool according to claim 1, wherein the at least one first bearing is a ball race.

8. The power tool according to claim 7, wherein the rotationally symmetric part of the external circumferential surface of the eccentric element has a rotational symmetry in respect to a rotation about the first rotational axis by any angle.

9. The power tool according to claim 1, wherein the at least one first bearing comprises at least two first bearings provided between the rotationally symmetric part of the external circumferential surface of the eccentric element and the static body of the power tool, the at least two first bearings being spaced apart from each other in a direction along the first rotational axis.

10. The power tool according to claim 1, wherein the eccentric element comprises a fulcrum pin connected to the eccentric element in a freely rotatable manner about the second rotational axis; and the fulcrum pin comprises an enlarged head portion configured for insertion into a respective recess provided on a top surface of the plate-like backing pad and also for releasable attachment of the plate-like backing pad to the fulcrum pin.

11. The power tool according to claim 10, wherein the eccentric element comprises at least one second bearing provided between the eccentric element and the fulcrum pin so that the fulcrum pin is guided in respect to the eccentric element in a freely rotatable manner about the second rotational axis.

12. The power tool according to claim 11, wherein the at least one first bearing is located on the rotationally symmetric part of the external circumferential surface of the eccentric element in such a manner so as to surround at least part of the at least one second bearing.

13. The power tool according to claim 1, wherein the power tool comprises a turbine attached to, or forming an integral part of, the eccentric element on a side of the eccentric element directed towards the backing pad connected thereto.

14. The power tool according to claim 13, wherein the power tool comprises a counter weight attached to or forming an integral part of the eccentric element or the turbine on a side of the eccentric element directed towards the plate-like backing pad connected thereto.

15. A power tool, including a hand-held and hand-guided random orbital polishing or sanding power tool, comprising:

a static body, a motor, an eccentric element driven by the motor and performing a rotational movement about a first rotational axis, and a plate-like backing pad connected to the eccentric element in a manner freely rotatable about a second rotational axis, first and second rotational axes extending substantially parallel to one another and are spaced apart from one another;

at least part of an external circumferential surface of the eccentric element having an at least discrete rotational symmetry in respect to the first rotational axis so as to form a rotationally symmetric part of the eccentric element;

the power tool having at least one first bearing provided between the rotationally symmetric part of the external circumferential surface of the eccentric element and the static body of the power tool so that the eccentric element is guided in respect to the static body in a manner rotatable about the first rotational axis; and the power tool having a mechanical gear arrangement with at least two meshing gear wheels, the mechanical gear arrangement being provided functionally between a driving shaft driven by the motor and the eccentric element, and at least one of the at least two meshing gear wheels being attached to the eccentric element in a manner adapted for transmitting torque to the eccentric element, wherein the mechanical gear arrangement comprises a first central gear wheel, a plurality of first pinion gear wheels meshing the first central gear wheel, a plurality of second pinion gear wheels each located coaxial to one of the plurality of first pinion gear wheels and attached thereto in a torque proof manner or forming an integral part of the respective first pinion gear wheel, and a second central gear wheel meshing the plurality of second pinion gear wheels; and the second central gear wheel is attached to the eccentric element in a torque proof manner or the second central gear wheel forms an integral part of the eccentric element.

16. The power tool according to claim 15, wherein the first central gear wheel is attached to the driving shaft in a torque proof manner or forms an integral part of the driving shaft, and each of the plurality of first pinion gear wheels together with the plurality of second pinion gear wheel are attached to the static body of the power tool in a freely rotatable manner.

* * * * *